US007028763B2

(12) United States Patent
Garner et al.

(10) Patent No.: US 7,028,763 B2
(45) Date of Patent: Apr. 18, 2006

(54) COOLING ARRANGEMENT AND METHOD WITH SELECTED SURFACES CONFIGURED TO INHIBIT CHANGES IN BOILING STATE

(75) Inventors: Colin Peter Garner, Loughborough (GB); Adrian Holland, Alton (GB)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/732,217

(22) Filed: Dec. 11, 2003

(65) Prior Publication Data

US 2004/0200442 A1 Oct. 14, 2004

(30) Foreign Application Priority Data

Dec. 12, 2002 (EP) ..... 02258581

(51) Int. Cl.
*F28F 13/18* (2006.01)

(52) U.S. Cl. ..... 165/133; 165/907; 165/911

(58) Field of Classification Search ..... 165/133, 165/907, 911
See application file for complete search history.

(56) References Cited

U.S. PATENT DOCUMENTS 3,313,276 A * 4/1967 Ito et al. ..... 418/61.2
3,384,160 A * 5/1968 Beurtheret ..... 165/104.21
3,836,293 A * 9/1974 Lamm ..... 418/83
3,964,445 A * 6/1976 Ernest et al. ..... 418/83
4,037,998 A * 7/1977 Goloff ..... 418/83
4,050,507 A 9/1977 Chu et al.
4,093,755 A * 6/1978 Dahl et al. ..... 427/451
4,136,427 A * 1/1979 Shum ..... 29/890.045
4,434,842 A * 3/1984 Gregory ..... 165/133
4,474,231 A 10/1984 Staub et al.
4,531,900 A * 7/1985 Jones et al. ..... 418/61.2
4,619,316 A * 10/1986 Nakayama et al. .... 165/104.33
4,653,572 A * 3/1987 Bennett et al. ..... 165/133
4,768,484 A * 9/1988 Scarselletta ..... 123/41.21
5,031,579 A 7/1991 Evans
5,530,295 A * 6/1996 Mehr ..... 257/796
5,544,696 A 8/1996 Leland
6,371,199 B1 * 4/2002 Gebhart ..... 165/47

FOREIGN PATENT DOCUMENTS

EP 0 206 124 A2 12/1986

OTHER PUBLICATIONS

Patent Abstracts of Japan, English Abstract for JP Pub. No. 6024390, Dec. 3, 1985.

(Continued)

*Primary Examiner*—Teresa J. Walberg
(74) *Attorney, Agent, or Firm*—Finnegan, Henderson, Farabow, Garrett & Dunner LLP

(57) ABSTRACT

Heat transfer in coolant circuits, as in an internal combustion engine for example, can be beneficially enhanced by maintaining the coolant in a nucleate boiling state, but undesirable transitions to a film boiling state are then possible. The disclosed coolant circuit has selected surface(s) that have a tendency to experience high heat flux in comparison to adjacent surfaces in the coolant circuit. These surfaces are provided with a surface configuration, such as a matrix of nucleation cavities, which has a tendency to inhibit a change in boiling state. The surface configuration can be provided on the parent coolant circuit surface or on a surface of an insert positioned in the coolant circuit. Thus, transitions to film boiling can be effectively avoided at locations in the coolant circuit that are susceptible to such transitions.

55 Claims, 4 Drawing Sheets

OTHER PUBLICATIONS

Patent Abstracts of Japan, English Abstract for JP Pub. No. 61015088, Jan. 23, 1986.
A. Holland et al., "Nucleate Boiling From Micro-Machined Surfaces", Proceedings of HT2003, ASME Summer Heat Transfer Conference, Jul. 21-23, 2003, Las Vegas, Nevada, USA, 5 pages.
Dr. DBR Kenning, "EPSRC-supported project: Boiling in Compact Heat Exchangers," Abstract, date unknown, 1 page.
Dr. DBR Kenning, EPSRC-supported project: Nucleate Boiling Heat Transfer: Effect of Wall Properties & Surface Condition, Abstract, date unknown, 1 page.
Dr. C.P. Garner, "Fundamental Studies of Nucleate Boiling Dynamics for IC Engines", Department of Mechanical Engineering, Loughborough University, date unknown, 9 pages.
A. Holland, "The Effects of Micro-Machined Surface Features on Nucleate Boiling", Research Student End of Year 2 Progress Report, Oct. 1, 2002, 11 pages.
A. Singh et al., "Effect of Superheat and Cavity Size on Frequency of Bubble Departure in Boiling", Journal of Heat Transfer, vol. 99, May, 1977, pp. 246-249.
R. Rammig et al., "Growth of vapour bubbles from artificial nucleation sites", Cryogenics 1991, vol. 31, Jan., 1991, pp. 64-69.
P.J. Marto et al., "Pool Boiling Heat Transfer From Enhanced Surfaces to Dielectric Fluids", Journal of Heat Transfer, vol. 104, May, 1982, pp. 292-299.
A. Calka et al., "Some aspects of the interaction among nucleation sites during saturated nucleate boiling", Int. J. Heat and Mass Transfer, vol. 28, No. 12, pp. 2331-2341 (1985).
Robert Cole, "Bubble Frequencies and Departure Volumes at Subatmospheric Pressures", AIChE Journal , vol. 13, No. 4, Jul., 1967, pp. 779-783.
R.L. Judd et al., "The Nature of Nucleation Site Interaction", Journal of Heat Transfer, vol. 102, pp. 461-464 Aug. 1980.
V.V. Chekanov, "Interaction of Centres in Nucleate Boiling", Teplofiz V ysok Temp, vol. 15, pp. 121-128 (1977).
R.L. Judd et al., "Interaction of Nucleation Processes Occurring at Adjacent Nucleation Sites", Journal of Heat Transfer, vol. 115, pp. 955-962, Nov., 1993.
E. Ruckenstein, "A Physical Model for Nucleate Boiling Heat Transfer from a Horizontal Surface", Bul. Institutului Politechnic, vol. 23, pp. 79-88 (1961).
R.L. Judd, "On Nucleation Site Interaction", Journal of Heat Transfer, vol. 110, pp. 475-478, May, 1988.
Search Report from European Patent Office in related European Application, No. 02 25 8581.
Patent Abstracts of Japan, English Abstract for JP Pub. No. 60243490, Dec. 3, 1985.

* cited by examiner

COOLING ARRANGEMENT AND METHOD WITH SELECTED SURFACES CONFIGURED TO INHIBIT CHANGES IN BOILING STATE

TECHNICAL FIELD

This invention relates to a cooling arrangement and related method in which at least one selected surface in a coolant circuit has a surface configuration adapted to inhibit changes in boiling state, such as departure from nucleate boiling to a film boiling state.

BACKGROUND

Heat transfer in coolant circuits can be enhanced by maintaining the coolant in a nucleate boiling heat transfer regime. However, during nucleate boiling heat transfer, the heat flux can reach critical heat flux (CHF) at which point further increases in heat flux cause a departure from nucleate boiling (DNB). This phenomenon is illustrated graphically in FIG. 1. When the coolant reaches departure from nucleate boiling, an increase in heat flux can cause the coolant to jump instantly to a film boiling state in which the temperature $T_s$ of surfaces in the coolant circuit can rise rapidly to several hundred or thousands of degrees above the saturation temperature $T_{sat}$ of the coolant. Consequently, surfaces in the coolant circuit can be damaged, thus causing damage or catastrophic failure of the device being cooled.

Due to the benefits of nucleate boiling heat transfer, efforts have been made use nucleate boiling heat transfer while avoiding damage from film boiling. For example, in U.S. Pat. No. 4,474,231 to Staub et al., the entirety of an immersed surface is provided with a plurality of cavities configured in a manner intended to avoid film boiling at the surface. Although the Staub et al. arrangement may be advantageous in preventing film boiling at the surface, the Staub et al arrangement is subject to improvement since not all surfaces in a coolant circuit are equally susceptible to the high heat flux that results in departure from nucleate boiling. Thus, use of the Staub et al. approach can incur more expense than needed to achieve the desired result of avoiding film boiling. In addition, the Staub et al. arrangement only increases the critical heat flux associated with departure from nucleate boiling but does not change the superheat gradient during nucleate boiling heat transfer. Moreover, the Staub et al. approach is not useful if forming cavities on the parent surface to be cooled is not possible or not practical.

Accordingly, there is a need for a cost-effective and flexible cooling arrangement in which a surface configuration tending to inhibit boiling state transitions (e.g. transitions to film boiling) is applied to only selected surfaces in the coolant circuit that are considered susceptible to film boiling.

SUMMARY OF THE INVENTION

In accordance with one aspect of this invention, a cooling arrangement utilizing a coolant having a boiling state comprises a coolant circuit having a high-heat surface therein to be cooled, the high-heat surface having a tendency to experience high heat flux in comparison to adjacent surfaces in the coolant circuit. A surface configuration is provided on at least a portion of the high-heat surface. The surface configuration tends to inhibit a change in boiling state of the coolant. In one embodiment, the cooling arrangement comprises an insert having an insert surface forming at least a portion of the coolant circuit surface, and the surface configuration is provided on at least a portion of the insert surface.

According to another aspect of this invention, a method for altering the boiling character of a coolant on a surface in a coolant circuit is disclosed. The method comprises identifying a high-heat surface in the coolant circuit having a tendency to experience high heat flux in comparison to adjacent surfaces in the coolant circuit, and providing a surface configuration on at least a portion of the high-heat surface. The surface configuration tends to inhibit a change in boiling state of the coolant. In one embodiment, the method includes providing an insert having an insert surface adapted to form at least a portion of the coolant circuit surface, and positioning the insert in the coolant circuit.

Other features and aspects of this invention will be apparent from the following description and the accompanying drawings.

DETAILED DESCRIPTION

Figure 2:
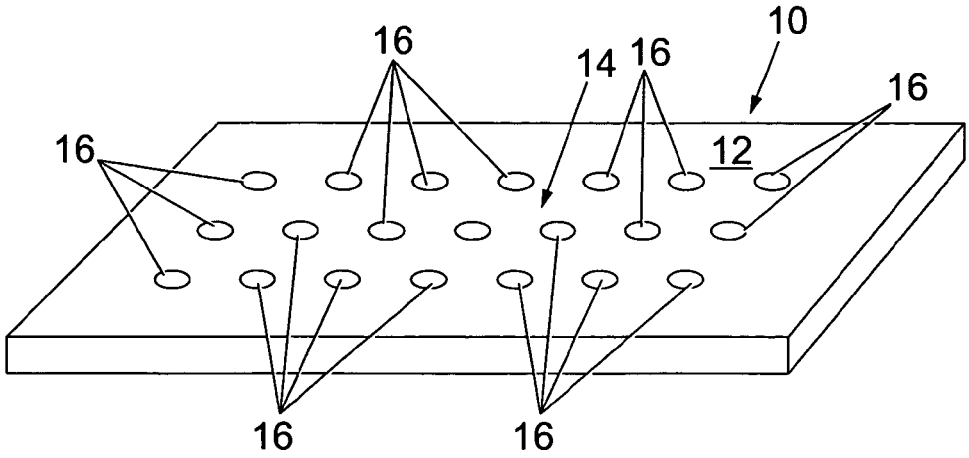
FIG. 2 is an isometric view of a first embodiment of a coolant circuit insert in accordance with this invention.

FIG. 2 illustrates a coolant circuit insert 10 in accordance with this invention. The coolant circuit insert 10 has an insert surface 12 that is provided with a surface configuration, such as a matrix 14 of substantially uniform nucleation cavities 16, that tend to inhibit departure from nucleate boiling in coolant adjacent to the insert surface 12. The shape, size, and pattern of the nucleation cavities are selected to control the rate of bubble growth, the bubble size at departure, the frequency of departure, and the temperature at which bubbles form. The insert 10 may be positioned in a coolant circuit (see FIGS. 9–11) such that the insert surface 12 forms a surface of the coolant circuit and is exposed to coolant in the coolant circuit. The insert 10 is advantageously positioned at a location that has a tendency to experience high levels of heat flux in comparison to adjacent surfaces in the coolant circuit, and more particularly, at a location that is susceptible heat flux sufficiently high to result in departure from nucleate boiling.

Figure 3:
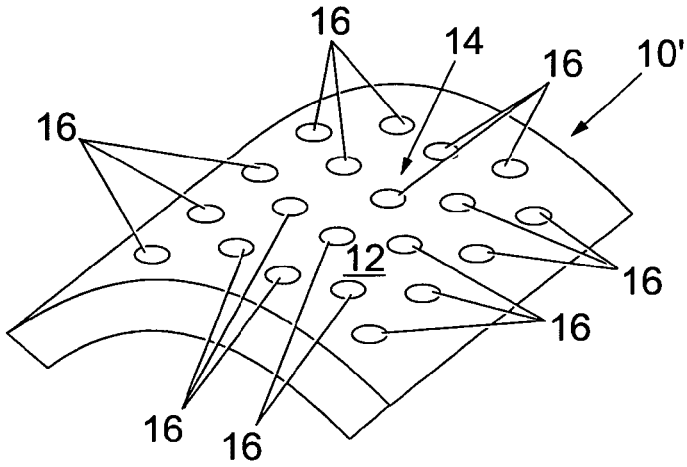
FIG. 3 is an isometric view of a second embodiment of a coolant circuit insert in accordance with this invention.

The coolant circuit insert 10 can be formed as a metal body, preferably using non-ferrous metal such as stainless steel or aluminum to avoid rusting or corrosion from exposure to the coolant, or the insert 10 may be formed from silicon, a suitable polymer, or any other material having suitable heat transfer characteristics. The illustrated insert 10 has a planar insert surface 12 and is thus configured for use in forming a planar surface in the coolant circuit. FIG. 3 illustrates a coolant insert, designated 10', in which the coolant surface 12 is a curved surface. As apparent, the insert 10' is configured for use at curved surfaces in the coolant circuit. The illustrated inserts 10, 10' have a rectangular shape in plan view, but the inserts may be configured to have any geometric shape or even a free-form shape. In addition, multiple individual inserts may be positioned adjacent each other to form a larger insert arrangement but can be considered a single insert for purpose of this invention. Thus, planar and curved inserts may be used together as need to create an insert surface that conforms to the parent surface of the coolant circuit. In addition, the insert may comprise a tubular member, with the surface configuration provided on either the inwardly facing or the outwardly facing surfaces of the tubular member.

Normal handling of metal parts such as the insert 10 can leave a surface that, although perhaps smooth to the naked eye, has many random surface cavities. Prior to or potentially after forming the nucleation cavities 16 in the insert surface 12, the insert surface 12 can be polished or otherwise processed to remove the randomly spaced and randomly sized cavities and scratches in the surface. By removing the random cavities on the surface 12, nucleation will occur only at the nucleation cavities 16, whose size and shape and locations are selected as described below to inhibit departure from nucleate boiling. For example, since random small cavities smaller than nucleation cavities 16 are removed from the surface 12, increasing heat flux after nucleation begins at cavities 16 does not activate additional cavities that would otherwise be activated and increase the level of nucleate boiling. Of course, the benefits of this invention can be achieved to at least some extent if the insert surface 12 is not polished.

The nucleation cavities 16 can be formed as blind recesses in the insert surface 12 or, alternatively, the nucleation cavities can be formed by forming holes or passages that extend from the insert surface 12 through to the opposite surface of the insert 10. In the latter case, the thickness of the insert 10 defines the depth of the cavities 16, with the bottom wall of the cavities 16 being formed by the parent surface of the coolant circuit to which the insert 10 is mounted. The nucleation cavities 16 can be formed by any suitable process, such as use of a laser or by stamping the surface, as with a diamond-headed indenter for example. An Nd:YAG laser system or an Excimer laser system are examples of laser systems considered suitable for use in creating the nucleation cavities 16, but other laser systems capable of machining or etching cavities having the desired shape and dimensions could be used.

Figure 4:
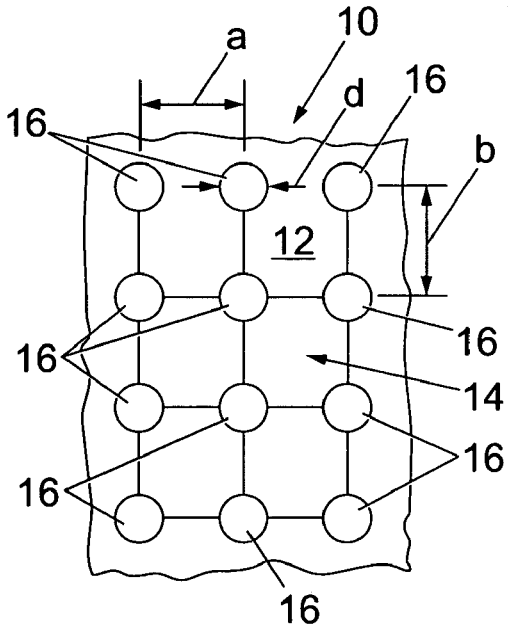
FIG. 4 is an enlarged, fragmentary plan view of a first embodiment of a surface configuration in accordance with this invention.

FIG. 4 illustrates one embodiment of a matrix 14 of nucleation cavities 16 that can form the surface configuration on the coolant insert surface 12. The matrix 14 of FIG. 4 is a so-called rectangular matrix in which nucleation cavities 16 are arranged in plural rows of uniformly spaced cavities and in which cavities 16 in adjacent rows are aligned. The nucleation cavities 16 having a cavity diameter d. Nucleation cavities 16 in each row are substantially uniformly spaced by a cavity separation distance a, and adjacent rows of nucleation cavities 16 are substantially uniformly spaced apart by a row separation distance b. The particular rectangular matrix illustrated in FIG. 4 is a square matrix in which the cavity separation distance a and the row separation distance b are substantially equal.

Figure 5:
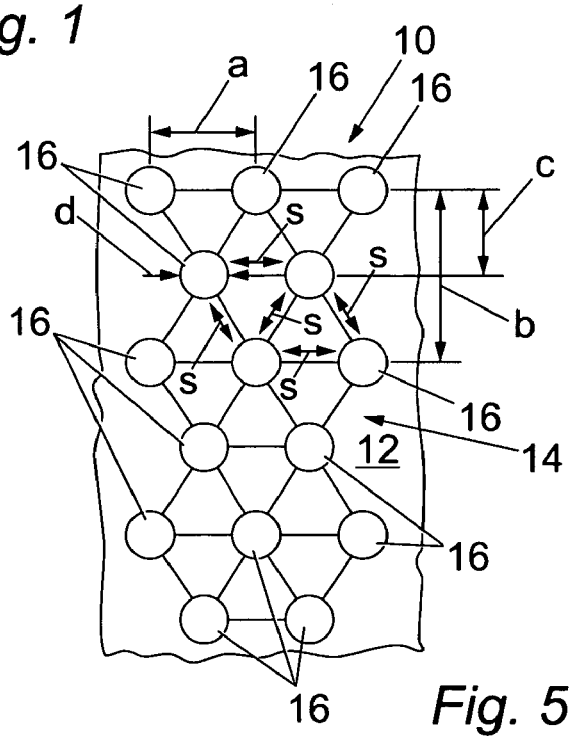
FIG. 5 is an enlarged, fragmentary plan view of second embodiment of a surface configuration in accordance with this invention.

FIG. 5 illustrates a second embodiment of a nucleation cavity matrix 14. The matrix of FIG. 5 is a so-called equilateral triangle matrix in which each nucleation cavity 16 is substantially equally spaced by a distance S from adjacent cavities 16. For any selection of three adjacent nucleation cavities 16, each of the cavities is positioned at the point of an equilateral triangle. This matrix can be formed by forming rows of cavities 16. In each row, the nucleation cavities 16 are mutually spaced by a substantially uniform distance a. A second row is spaced apart from a first row by a distance c, and nucleation cavities 16 in the second row are laterally positioned substantially midway between nucleation cavities 16 in the first row. A third row of nucleation cavities 16 is spaced from the first row by a distance b, with the cavities in the second adjacent row being aligned with cavities in the first row. A fourth row similar to the second row is provided, and so on.

Optimal cavity spacing S and cavity diameter d for any given application can be determined by analysis and limited experimentation. As apparent from the drawings, cavity spacings such as a, b (FIG. 4), and S (FIG. 5), which are each referred to herein generically as a cavity spacing S, are measured as distances between the centers of cavities. Certain general guidelines may be applied to select the cavity spacing S and cavity diameter d. Cavity activation temperature (e.g. the superheat temperature at which nucleation begins) is predicted as a function of the minimum cavity radius $$r_{\min} = \frac{2 \cdot \sigma \cdot T_{sat} v_{fg}}{h_{fg} \cdot \Delta T}$$

where $v_{fg}$ is the specific volume of evaporation, σ is surface tension, and $h_{fg}$ is the enthalpy of evaporation, $T_{sat}$ is the coolant saturation temperature, and ΔT is the superheat temperature ($T_s - T_{sat}$). Thus, for superheat temperatures below ΔT, only cavities having a radius of greater than $r_{min}$ will produce nucleation. Nucleation cavity diameter d can be selected to be in the range of about 10 μm to about 250 μm, especially for conventional coolant liquids with superheat temperatures up to about 10° C. In addition, interaction between adjacent nucleation sites can have the effect of making bubble formation and departure unpredictable, since departing bubbles can create turbulence that affect the formation and departure of bubbles at adjacent nucleation sites. To avoid interaction between nucleation sites, the nucleation cavities 16 can be spaced by a distance S where the ratio of cavity spacing S to the bubble departure diameter $D_b$ is greater than or equal to about three ($S/D_b \geqq 3$). Of course, cavity spacing slightly less than three may be sufficient to avoid interaction between nucleation sites in some cases. Bubble departure diameter $D_b$ can be predicted by the equation $$D_b = \left[\frac{\rho_l \alpha^2}{g(\rho_l - \rho_v)}\right]^{\frac{1}{3}} \left[\frac{\rho_l C_p \Delta T}{\rho_v \lambda}\right]^{\frac{4}{3}}$$

where $\rho_1$ is the liquid coolant density, $\rho_v$ is the vapor coolant density, $\alpha$ is the thermal diffusivity, g is the gravitational constant, $C_p$ is specific heat, $\Delta T$ is the superheat temperature $T_s - T_{sat}$, and $\lambda$ is the latent heat of evaporization. For excess temperature or superheat $\Delta T$ in the range of about 1° C. to about 10° C., bubble diameter of conventional coolant is predicted to be in the range of about 0.1 mm to about 1.4 mm. Thus, in an effort to avoid nucleation site interaction, spacing S between nucleation cavities 16 can be selected to be in the range of about 0.3 mm to about 4.2 mm.

Although not necessarily the case, a larger cavity diameter d will typically be associated with smaller cavity spacing S and vice versa. This is generally true due to the interaction between bubble departure diameter, superheat, and desired cavity spacing. As mentioned above, bubble departure diameter $D_b$ determines the desired spacing of nucleation cavities if site interaction is to be avoided. Bubble departure diameter $D_b$ is a function, in part, of superheat $\Delta T$. Thus, higher levels of superheat $\Delta T$ results in larger diameter bubbles and thus in a selection of larger spacing S between nucleation cavities 16. At the same time, higher levels of superheat $\Delta T$ activates smaller diameter nucleation cavities. Thus, cavity diameter d and cavity spacing S can be selected based on the superheat temperature $\Delta T$ at which start of nucleate boiling is desired, where increasing the target superheat temperature $\Delta T$ associated with onset of nucleate boiling results in selecting a larger cavity spacing and a smaller cavity diameter d.

As mentioned above, a spacing S between adjacent cavities 16 that is sufficient to avoid undesired interaction between adjacent cavities 16 can be desirable. In this regard, the undesired interaction is one where a bubble from one cavity 16 might merge before departure with a bubble formed at a nearby cavity 16, which could lead to a large bubble overlying the surface 12 between the cavities 16 and thus to localized film boiling. In some situations, a smaller cavity spacing S may in fact be desirable to ensure that nucleation starts at most or all of the cavities 16, thereby increasing the heat transfer effects. It is possible that a cavity 16 may not nucleate except at extraordinarily high levels of heat flux because no residual vapor is trapped in the cavity 16. If the cavity spacing S is sufficiently small, turbulence or other forces can cause some bubbles to transit or transfer between cavities 16 before the buoyancy of the bubble is sufficiently high to cause normal bubble departure as discussed above. In this case, a bubble can transit along the surface 12 toward another cavity 16, the bubble being held to the surface 12 by surface tension that exceeds the bubble's buoyancy force. As the bubble transits laterally from its initial cavity 16, the bubble is sheared at or about the opening of the cavity 16, thus leaving a residual amount of vapor in the initial cavity 16 that can grow to form a new bubble, thereby allowing continued nucleation at the initial cavity 16. If the transiting bubble reaches another cavity 16 before its buoyancy exceeds surface tension, then the bubble will deposit vapor into the new cavity 16 and will grow until it reaches its usual bubble departure size. When the bubble departs the new cavity 16 in normal fashion, the departure shearing mentioned above will leave residual vapor in the cavity 16. As a result, the new cavity 16 will continue to nucleate. In this way, the transit of bubbles across the surface 12 can allow a higher number of the cavities 16 to begin to nucleate, thus increasing the heat transfer effects of the nucleate boiling. If the positive effects of bubble transit across the surface 12 is desired, the cavity spacing S should be selected to be sufficiently large to avoid undesirable interaction but sufficiently small to allow for bubble transit. In this regard, the ratio of cavity spacing S to the bubble departure diameter $D_b$ can be selected to be greater than or equal to about one ($S/D_b \geqq 1$). A ratio of one or just marginally greater than one may be satisfactory, and observations indicate that a ratio of 2 is too large to allow for beneficial bubble transit effects. If liquid is flowing across the surface or the liquid is otherwise turbulent, then the ratio $S/D_b$ might be selected to be somewhat higher than in no-flow or low-turbulence conditions since the flow or turbulence can encourage bubble transit.

Figure 6:
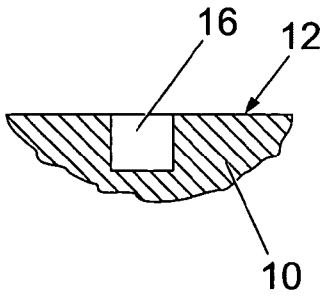
FIG. 6 through 8 are fragmentary cross-sectional views of exemplary nucleation cavity configurations that may be used in connection with this invention.
Figure 7:
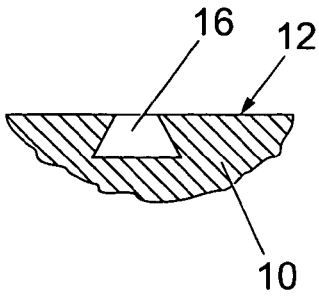
Figure 8:
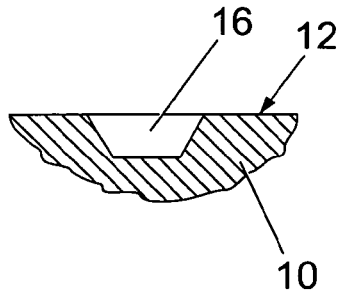

The depth of the nucleation cavities 16 is selected to be at least sufficient that surface tension will not preclude coolant from entering the cavities. Preferably, however, the depth of the nucleation cavities is selected to be at least equal to the diameter d of the nucleation cavities 16, thus provide a depth-to-width ration of at least 1. Of course, the depth-to-width ratio can be greater than 1 without departing from the scope of this invention. The nucleation cavities 16 may have a variety of shape, such as shapes that have parallel sidewalls and thus a uniform cross-sectional area along the depth of the cavity 16 as shown in FIG. 6. The shape may also be a re-entrant shape as shown in FIG. 7 in which the sidewalls diverge from the opening at the surface 12, thus providing an increasing cross-sectional shape long the depth. Similarly, the sidewalls may diverge from the bottom of the cavity 16 toward the opening at the surface 12 as shown in FIG. 8, thus providing a decreasing cross-sectional area along the depth of the cavity 16. The opening of the cavities 16 may have any suitable shape, such as a circular, oval, triangular, rectangular, any polygonal, or any free-form shape for example.

Figure 1:
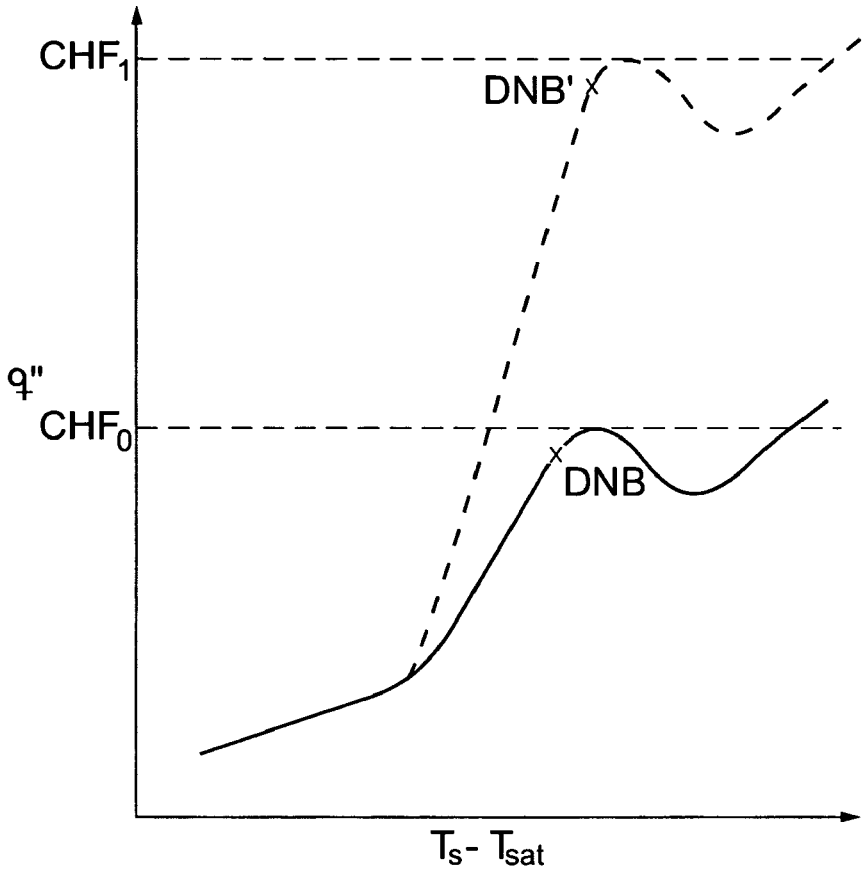
FIG. 1 is a graphical representation of heat transfer from a surface in a coolant circuit to coolant adjacent to the surface.

Referring back to FIG. 1, the use of a surface configuration as described above at selected locations within a coolant circuit effectively inhibits changes transitions from nucleate boiling to film boiling. In this regard, transitions from nucleate boiling to film boiling are not absolutely prevented, but they are avoided for practical ranges of heat flux. The solid line graph in FIG. 1 illustrates the heat transfer regimes of an ordinary, untreated surface in a coolant circuit, which may have any number of randomly spaced and randomly sized cavities formed therein. As a result, as heat flux increases and nucleate boiling becomes more vigorous, the coolant to reach departure from nucleate boiling at a critical heat flux $q''=CHF_0$. In addition, during the nucleate boiling phase, the superheat gradient, $d(T_s - T_{sat})/dq''$, is relatively high. The superheat temperature $\Delta T$ at which nucleation and nucleate boiling occur can be pre-selected by selecting and appropriate cavity diameter d together with appropriate cavity spacing S as described above. In addition, by specially preparing the insert surface 12 to remove random, small diameter cavities (e.g. by polishing), heat flux can be increased without activating additional nucleation sites. Use of a surface configuration as described above causes the critical heat flux associated with departure from nucleate boiling to be increased to $q''=CHF_1$, as indicated by the dashed line curve in FIG. 1. Moreover, the superheat gradient is decreased as indicated by the steeper dashed line during nucleate boiling. Thus, not only are higher heat flux levels required to reach the new departure from nucleate boiling at point DNB', but changes in heat flux result in smaller increases in excess temperature or superheat at the locations where the surface configuration is provided.

INDUSTRIAL APPLICABILITY

Figure 9:
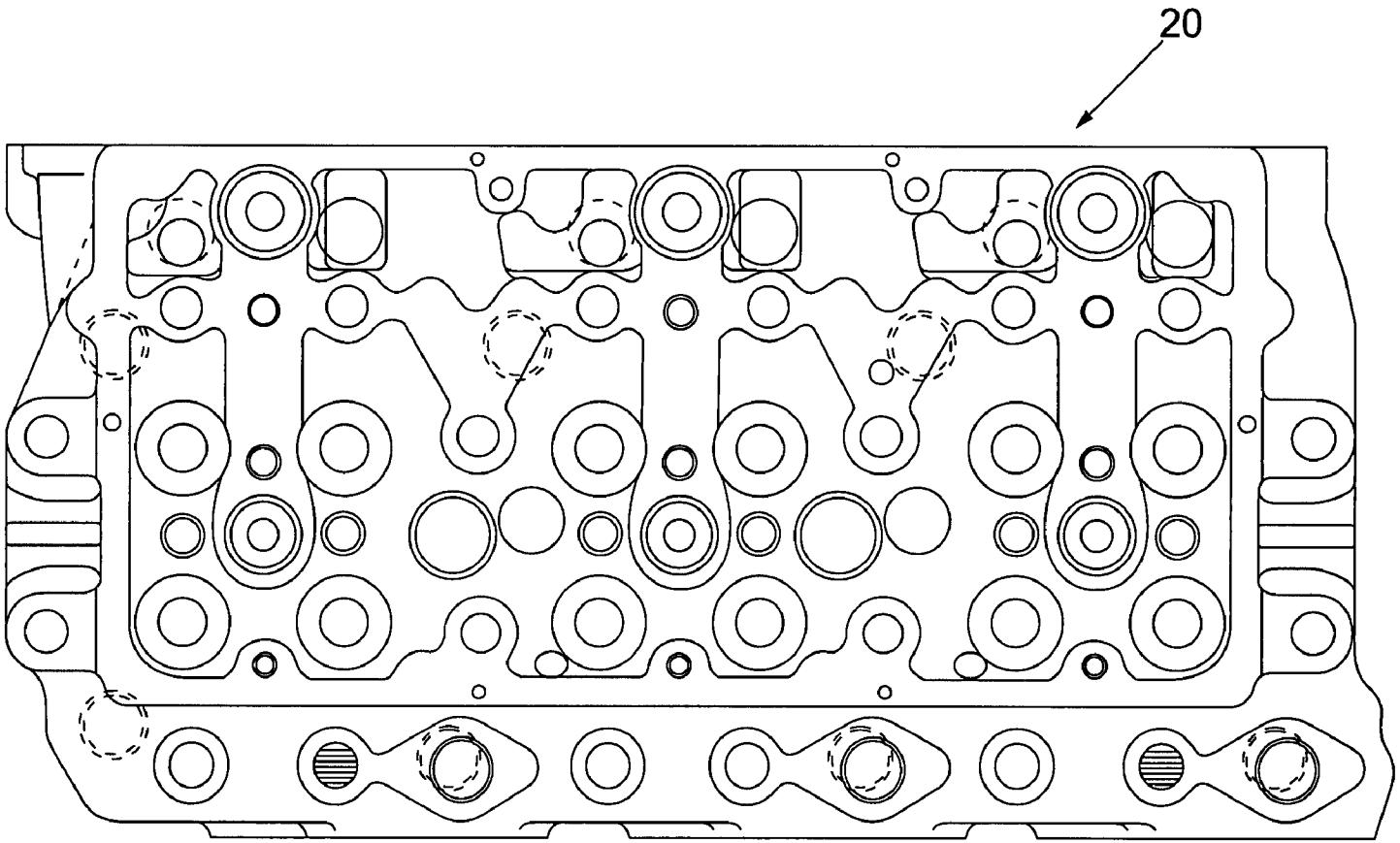
FIG. 9 is a plan view of an exemplary cylinder head of an internal combustion engine with which this invention may be used.
Figure 10:
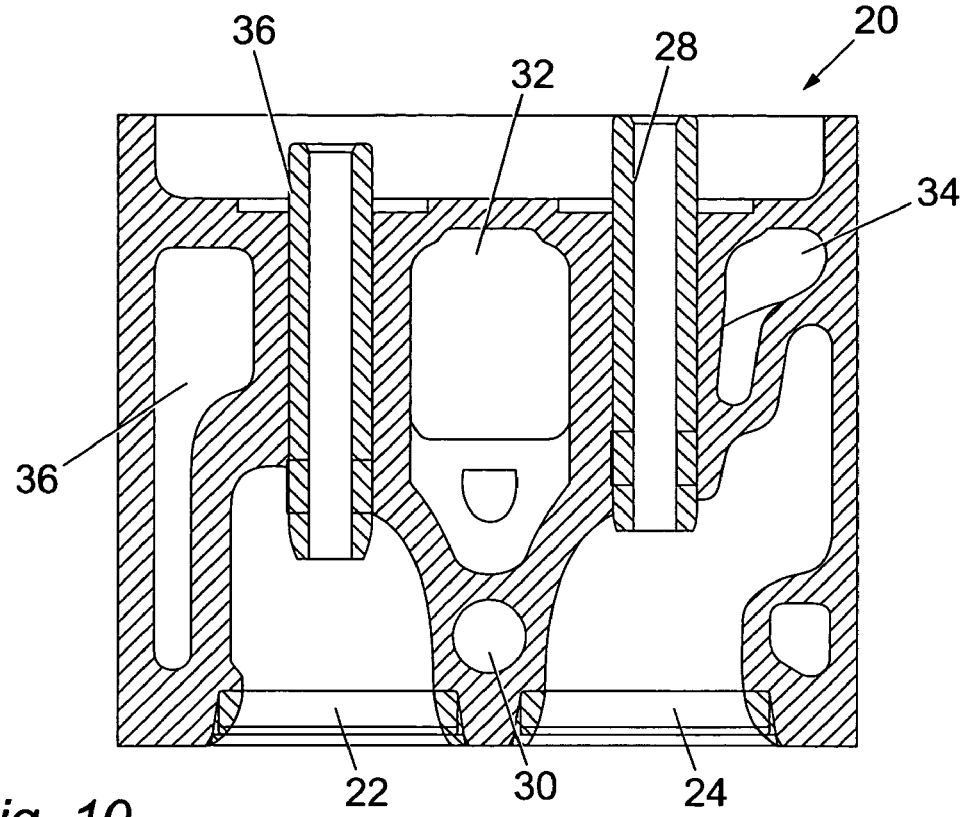
FIG. 10 is a fragmentary cross-sectional view taken along lines 10—10 of FIG. 9 prior to application of a cooling arrangement in accordance with this invention.
Figure 11:
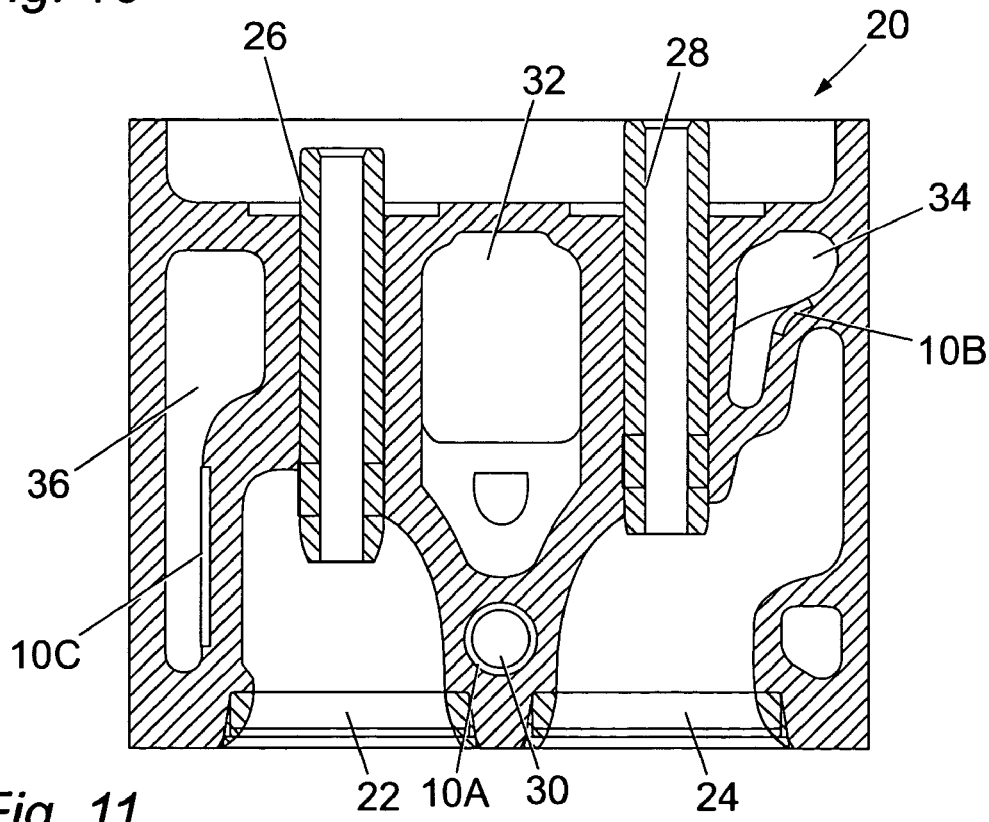
FIG. 11 is fragmentary cross-sectional view similar to FIG. 10 but showing coolant circuit inserts applied in accordance with this invention.

FIGS. 9 through 11 show an exemplary use of a cooling arrangement in accordance with this invention. FIG. 9 is a top plan view of a conventional cylinder head 20 for an internal combustion engine (not shown), which cylinder head 20 include various coolant passages that form part of a coolant circuit of the engine. With reference to FIG. 10, which shown a portion of the cylinder head 20 without or prior to application of the cooling arrangement of this invention, the cylinder head 20 includes an intake port 22 and an exhaust port 24 that are respectively opened and closed by intake and exhaust valves (not shown). Each valve conventionally includes a valve body portion that opens or closes the port 22, 24 and a valve stem portion that extends upwardly through a valve guide 26, 28. During operation of the engine, hot gases from combustion are discharged from the combustion chamber (not shown) through the exhaust port 24. The combustion process and the discharge of exhaust gases cause the cylinder head surface temperatures to increase. Various coolant passages 30, 32, 34, 36 extend within the cylinder head 20 and form part of a coolant circuit. Coolant flows through the coolant passages 30, 32, 34, 36 to cool the surfaces of the cylinder head 20, and the heated coolant is then delivered to a heat exchanger in a well-known manner. Coolant passage 30 extends through the valve bridge, which is the portion of the cylinder head 20 that is between the intake port 22 and the exhaust port 24.

FIG. 11 show the cylinder head 20 fitted with a cooling arrangement in accordance with this invention. In the illustrated embodiment, coolant circuit inserts 10A, 10B, 10C is provided in each of the coolant passages 30, 34, and 36, respectively. Of course, any number of inserts 10 could be used at various locations within the coolant circuit. The insert 10A is provided in the coolant passage 30 that extends through the valve bridge. The insert 10A is a tubular member as described above. The tubular insert 10A can be mounted in position by "cool-shrink" process in which the insert 10A is cooled to shrink its size and then inserted into a bore or hole that substantially matches the cooled size of the insert 10A. Thus, at normal temperatures, the insert 10A expands and is thus held within the bore. The insert 10A can alternatively be formed from plural arcuate insert sections. The insert 10B has a curved insert surface 12 as described above with regard to FIG. 3. The insert 10C has a substantially planar insert surface 12 as described above with regard to FIG. 2.

The inserts 10 can be secured to the cylinder head 20 in a variety of manners. Where the locations within the cooling passages 30, 32, 34, 36 are accessible after casting of the cylinder head, the inserts 10 can be held in position by suitable fastening means, such a "cool-shrink" fitting as mentioned above, press-fitting, welding, or use of adhesives. In many cases, however, the desirable locations for inserts 10 are locations that are not easily accessible after the cylinder head 20 has been cast. In those cases, the inserts 10 can be positioned in the cast cylinder head 20 during the casting process. The inserts 10 would be positioned into the sand mold used to cast the cylinder head 20 so that, when molten metal is poured or injected into the mold, the inserts would adhere to the resultant cylinder head 20 is the selected locations.

In some cases, the surfaces of the cylinder head 20 or other coolant circuit surfaces may be readily accessible after the casting or other forming process. In those cases, the surface configuration of this invention can be provided without use of an insert by optionally polishing or otherwise preparing the coolant circuit surface and forming the surface configuration, such as the matrix 14 of nucleation cavities 16, directly on the parent surface. For internal combustion engine applications, however, it is expected that this method may have limited application since most coolant circuit surfaces will not be sufficiently accessible.

Although the preferred embodiments of this invention have been described herein, improvements and modifications may be incorporated without departing from the scope of the following claims. For example, although this invention is described in detail in the context of a cooling arrangement for an internal combustion engine, this invention may also be applied to any application in which selected surface in a coolant circuit have a tendency to experience higher levels of heat flux compared to adjacent surface and/or are more susceptible to film boiling.

What is claimed is:

1. A cooling arrangement utilizing a coolant having a boiling state, comprising:

a coolant circuit having a high-heat surface therein to be cooled, said high-heat surface having a tendency to experience high heat flux in comparison to adjacent surfaces in the coolant circuit;

wherein at least a portion of the high-heat surface includes a surface configuration, said surface configuration including a plurality of cavities in said high-heat surface tending to inhibit departure from nucleate boiling in the coolant.

2. The cooling arrangement of claim 1 wherein said surface configuration is only on a portion of said high-heat surface.

3. The cooling arrangement of claim 1 wherein the coolant circuit includes at least one coolant passage configured to direct flow of coolant, and at least a portion of the high-heat surface includes an insert surface on an insert forming at least a portion of said passage, and wherein said surface configuration is on at least a portion of said insert surface.

4. The cooling arrangement of claim 3 wherein at least one surface in the coolant circuit is adjacent to said insert surface and is devoid of said surface configuration.

5. The cooling arrangement of claim 3 wherein said surface configuration is on substantially all of said insert surface.

6. The cooling arrangement of claim 1 wherein said surface configuration is configured to raise the critical heat flux associated with departure from nucleate boiling of coolant adjacent to said high-heat surface.

7. The cooling arrangement of claim 1 wherein said surface configuration decreases the superheat gradient of coolant adjacent to said high-heat surface.

8. The cooling arrangement of claim 1 wherein said surface configuration comprises a matrix of substantially uniform nucleation cavities.

9. The cooling arrangement of claim 8 wherein said high-heat surface is otherwise substantially free of cavities.

10. The cooling arrangement of claim 8 wherein said matrix comprises an equilateral triangle matrix in which each nucleation cavity is substantially equally spaced from adjacent nucleation cavities.

11. The cooling arrangement of claim 8 wherein said matrix comprises a rectangular matrix.

12. The cooling arrangement of claim 8 wherein adjacent nucleation cavities are spaced by a distance in the range of about 0.3 mm to about 4.2 mm.

13. The cooling arrangement of claim 8 wherein the nucleation cavities have a diameter in the range of about 10 μm to about 250 μm.

14. The cooling arrangement of claim 8 wherein the ratio of a distance between adjacent nucleation cavities to the diameter of bubbles that depart the nucleation cavities is at least 1.

15. The cooling arrangement of claim 8 wherein adjacent nucleation cavities are spaced apart by a distance sufficiently large to prevent bubble interaction between adjacent nucleation cavities and sufficiently small to permit bubble transit between adjacent cavities.

16. The cooling arrangement of claim 3 wherein said insert includes non-ferrous metal.

17. The cooling arrangement of claim 3 wherein said insert surface comprises a substantially planar surface.

18. The cooling arrangement of claim 3 wherein said insert surface comprises a curved surface.

19. The cooling arrangement of claim 3 wherein said insert comprises a tubular member.

20. The cooling arrangement of claim 19 wherein said tubular member has a radially inwardly facing surface, and wherein said insert surface comprises said radially inwardly facing surface.

21. The cooling arrangement of claim 3 wherein said coolant circuit is formed at least in part by a cast body, and wherein said insert is configured to be mounted to said cast body after the body is cast.

22. The cooling arrangement of claim 3 wherein said coolant circuit is formed at least in part by a cast body, and wherein said insert is configured to be fastened to said cast body during the casting of said body.

23. The cooling arrangement of claim 1 wherein said coolant circuit has plural surfaces each having a tendency to experience high heat flux in comparison to adjacent surfaces in the coolant circuit, and wherein each of said plural surfaces is provided with a surface configuration including a plurality of cavities in said high-heat surface having a tendency to inhibit departure from nucleate boiling in the coolant.

24. A method for altering the boiling character of a coolant on a surface in a coolant circuit, comprising:

identifying a high-heat surface in the coolant circuit having a tendency to experience high heat flux in comparison to adjacent surfaces in the coolant circuit; and providing a surface configuration including a plurality of cavities in said high-heat surface on at least a portion of said high-heat surface, said surface configuration tending to inhibit departure from nucleate boiling in the coolant.

25. The method of claim 24 further comprising:

providing an insert having an insert surface adapted to form at least a portion of said coolant circuit surface; and positioning said insert in a passage in said coolant circuit.

26. The method of claim 25 further comprising not providing the surface configuration on coolant circuit surfaces adjacent to said insert surface.

27. The method of claim 24 wherein said surface configuration raises the critical heat flux associated with departure from nucleate boiling of coolant adjacent to said high-heat surface.

28. The method of claim 24 wherein said surface configuration decreases the superheat gradient of coolant adjacent to said high-heat surface.

29. The method of claim 24 wherein said step of providing said surface configuration includes forming a matrix of substantially uniform nucleation cavities in said surface.

30. The method of claim 29 further wherein said step of providing said surface configuration further includes processing the surface so that it is substantially free from cavities other than said substantially uniform nucleation cavities.

31. The method of claim 29 wherein said matrix comprises an equilateral triangle matrix.

32. The method of claim 29 wherein said matrix comprises rectangular matrix.

33. The method of claim 29 wherein adjacent nucleation cavities are spaced by a distance in the range of about 0.3 mm to about 4.2 mm.

34. The method of claim 29 wherein the nucleation cavities have a diameter in the range of about 10 μm to about 250 μm.

35. The method of claim 29 wherein a ratio of the distance between adjacent nucleation cavities to the diameter of bubbles that depart the nucleation cavities is at least 1.

36. The method of claim 29 wherein adjacent nucleation cavities are spaced apart by a distance sufficiently large to prevent bubble interaction between adjacent nucleation cavities and sufficiently small to permit bubble transit between adjacent cavities.

37. The method of claim 25 further comprising:

casting a body that defines at least a portion of said coolant circuit; and securing said insert to said cast body.

38. The method of claim 25 further comprising:

positioning said insert against a surface of a mold adapted for casting a body that defines at least a portion of said coolant circuit; and casting said body so that said insert is secured in position in the coolant circuit defined by the cast body.

39. A cooling arrangement utilizing a coolant having a boiling state, comprising:

a coolant circuit having a circuit surface therein to be cooled, the circuit surface comprising a first surface and a second surface, the second surface being disposed adjacent to the first surface, said first surface having a tendency to experience high heat flux in comparison to the second surface, wherein the first surface includes a surface configuration including a plurality of cavities in said first surface configured to inhibit departure from nucleate boiling in the coolant.

40. The cooling arrangement of claim 39 further comprising at least one coolant passage configured to direct flow of coolant, and an insert in the coolant passage, the insert having an insert surface forming at least a part of the passage surface, wherein the insert surface at least partially comprises the first surface and at least part of the surface configuration is on the insert surface.

41. The cooling arrangement of claim 40 wherein the second surface is adjacent to the insert surface and is devoid of said surface configuration.

42. The cooling arrangement of claim 40 wherein said insert surface comprises at least one of a substantially planar surface, a curved surface, and a tubular member.

43. The cooling arrangement of claim 39 wherein said surface configuration is configured to raise the critical heat flux associated with departure from nucleate boiling of coolant adjacent to the first surface, and decrease the superheat gradient of coolant adjacent to the first surface.

44. The cooling arrangement of claim 39 wherein said surface configuration comprises a matrix of substantially uniform nucleation cavities.

45. The cooling arrangement of claim 40 wherein said coolant circuit is formed at least in part by a cast body, and wherein said insert is configured to be mounted to said cast body after the body is cast.

46. The cooling arrangement of claim 40 wherein said coolant circuit is formed at least in part by a cast body, and wherein said insert is configured to be fastened to said cast body during the casting of said body.

47. The cooling arrangement of claim 1, wherein the cooling circuit includes at least one coolant passage configured to direct flow of the coolant.

48. The cooling arrangement of claim 47, wherein the high-heat surface is within the at least one coolant passage.

49. The method of claim 24, including, wherein the cooling circuit includes at least one coolant passage configured to direct flow of the coolant.

50. The method of claim 49, wherein identifying the high-heat surface includes identifying the high-heat surface within the at least one coolant passage.

51. The cooling arrangement of claim 39, wherein the cooling circuit includes at least one coolant passage configured to direct flow of the coolant.

52. The cooling arrangement of claim 51, wherein the first surface is within the at least one coolant passage.

53. An internal combustion engine having coolant passages that form a part of an engine coolant circuit and that utilize a coolant having a boiling state, comprising:

a cylinder head having an intake port and an exhaust port, the exhaust port being configured to direct gases from a combustion chamber, the cylinder head also including a valve bridge disposed between the intake port and the exhaust port; and a coolant circuit having at least one coolant passage disposed through the cylinder head, the at least one coolant passage having surface walls configured to direct the coolant in the coolant circuit to provide cooling to the cylinder head, and the at least one coolant passage having a high-heat surface having a tendency to experience high heat flux in comparison to adjacent surfaces in the coolant circuit;

wherein at least a portion of the surface walls of the at least one coolant passage include a surface configuration including a plurality of cavities in said high-heat surface, said surface configuration tending to inhibit departure from nucleate boiling in the coolant.

54. The internal combustion engine of claim 53, wherein the at least one coolant passage extends through the valve bridge, and wherein at least a portion of the coolant passage surface extending through the valve bridge includes the surface configuration that tends to inhibit a change in the boiling state of the coolant.

55. The internal combustion engine of claim 53, wherein the at least one coolant passage includes at least one insert disposed therein, the insert forming a part of the surface walls, at least a portion of the insert including the surface configuration that tends to inhibit a change in the boiling state of the coolant.

* * * * *